US005785843A

United States Patent [19]

Antalffy et al.

[11] Patent Number: 5,785,843

[45] Date of Patent: Jul. 28, 1998

[54] LOW HEADROOM COKE DRUM DEHEADING DEVICE

[75] Inventors: Leslie Peter Antalffy, Houston; Robert Benoit, Richmond; Gerald Bryant, LaPorte; Michael B. Knowles; David W. Malek, both of Houston; Samuel Allen Martin, Sugarland, all of Tex.

[73] Assignee: Fluor Daniel, Inc., Irvine, Calif.

[21] Appl. No.: 738,184

[22] Filed: Oct. 28, 1996

Related U.S. Application Data

[62] Division of Ser. No. 346,610, Nov. 30, 1994.

[51] Int. Cl.[6] ..... C10G 9/014

[52] U.S. Cl. ..... 208/131; 208/127; 208/132; 196/96; 202/246

[58] Field of Search ..... 208/127, 131, 208/211; 196/130, 230; 202/96, 252, 246, 122

[56] References Cited

U.S. PATENT DOCUMENTS

| | | | |
|---|---|---|---|
| 5,048,876 | 9/1991 | Wallskog et al. | 55/364 |
| 5,098,524 | 3/1992 | Antalfy et al. | 202/96 |
| 5,228,825 | 7/1993 | Fruchtbaum et al. | 414/684.3 |
| 5,336,375 | 8/1994 | Wallskog et al. | 202/96 |

*Primary Examiner*—Helane Myers
*Attorney, Agent, or Firm*—Crockett & Fish

[57] ABSTRACT

A coke drum head is hinged to a coke drum body using a compound joint such as a trammel pivot, and the head is moved between open and closed positions using an actuator. In moving between open and closed positions, the head traces out a non-circular path which reduces the required headroom relative to a head using a standard pivot.

5 Claims, 8 Drawing Sheets

LOW HEADROOM COKE DRUM DEHEADING DEVICE

This application is a divisional of co-pending application Ser. No. 08/346,610 filed Nov. 30, 1994, now pending.

BACKGROUND OF THE INVENTION

The present invention relates to the field of hydrocarbon processing.

Many refineries recover valuable products from the heavy residual oil that remains after refining operations are completed. This recovery process, known as delayed coking, produces valuable distillates and coke in one or more large vessels known as coke drums.

Coke drums are typically large, cylindrical vessels having a top head and a frusto-conical bottom portion fitted with a bottom head. Coke drums are usually present in pairs so that they can be operated alternately. Thus, while one coke drum is being filled with residual oil and heated, the other drum is being cooled and purged of up to several hundred tons of coke formed during the previous recovery cycle. The operating conditions of delayed coking can be quite severe. Normal operating pressure typically range from 40 to about 60 pounds per square inch, and the feed input temperature may be over 900° F.

Coke recovery begins with a water quench step in which steam and water are introduced into the coke filled vessel to complete the recovery of volatiles and to cool the mass of coke. The vessel is then vented to atmospheric pressure and the top head (typically a 4-foot diameter flange) is unbolted and removed. A hydraulic coke cutting apparatus is inserted into the vessel to cut the cut the coke, and finally, the bottom head (typically a 7-foot diameter flange) is unbolted and removed to allow the hydraulically cut coke to fall out of the vessel and into a recovery chute. The process of moving the bottom head out of the way of the falling coke is herein referred to interchangeably by the terms deheading and unheading.

There are conceptually only two ways to move the bottom head out of the way of the falling coke. The first way is to completely remove the head from the vessel, perhaps carrying it away from the vessel on a cart. This process may be automated as set forth in U.S. Pat. No. 5,336,375, filed Dec. 15, 1993, entitled "Delayed Coker Drumhead Handling Apparatus," which is incorporated herein by reference. The other way of "removing" the bottom head is to swing it out of the way, as on a hinge or pivot, while the head is still coupled to the vessel. This process may also be automated, as set forth in Antalffy, et al., U.S. Pat. No. 5,098,524, filed Jul. 29, 1988, entitled "Coke Drum Unheading Device," commonly assigned with this application, and in the paragraph entitled "Closure Apparatus Application Example" of U.S. Pat. No. 5,048,876 issued Sep. 17, 1991, entitled "Closure Apparatus for Pipes and Vessels," each of which is also incorporated herein by reference.

Both complete and hinged removal of the head have advantages and disadvantages. Complete removal is advantageous in that it leaves ample room for the discharge of coke, but may require additional floor space, and may be more complicated and costly. Hinged removal is advantageous in that it may be more compact, simpler and more cost effective, but it may not be feasible where the bottom headroom is less than the diameter of the bottom head. In some instances, for example, it may be possible to raise the entire coking vessel, or to cut a hemispherical path for the head out of the adjacent floor, but both of these solutions may be impractical.

Thus, there is a further need for a method and system of deheading delayed coker vessels where the bottom head has less headroom than the diameter of the head. Other and further objects and advantages will appear hereinafter.

SUMMARY OF THE INVENTION

To these ends, a coke drum head is hinged to a coke drum body using a compound joint such as a trammel pivot, and the head is moved between open and closed positions using an actuator. In moving between open and closed positions, the head traces out a non-circular path which reduces the required headroom relative to a head using a standard pivot.

BRIEF DESCRIPTION OF THE DRAWING

In the drawings, wherein similar reference characters denote similar elements throughout the several views.

DETAILED DESCRIPTION OF THE DRAWINGS

Figure 1:
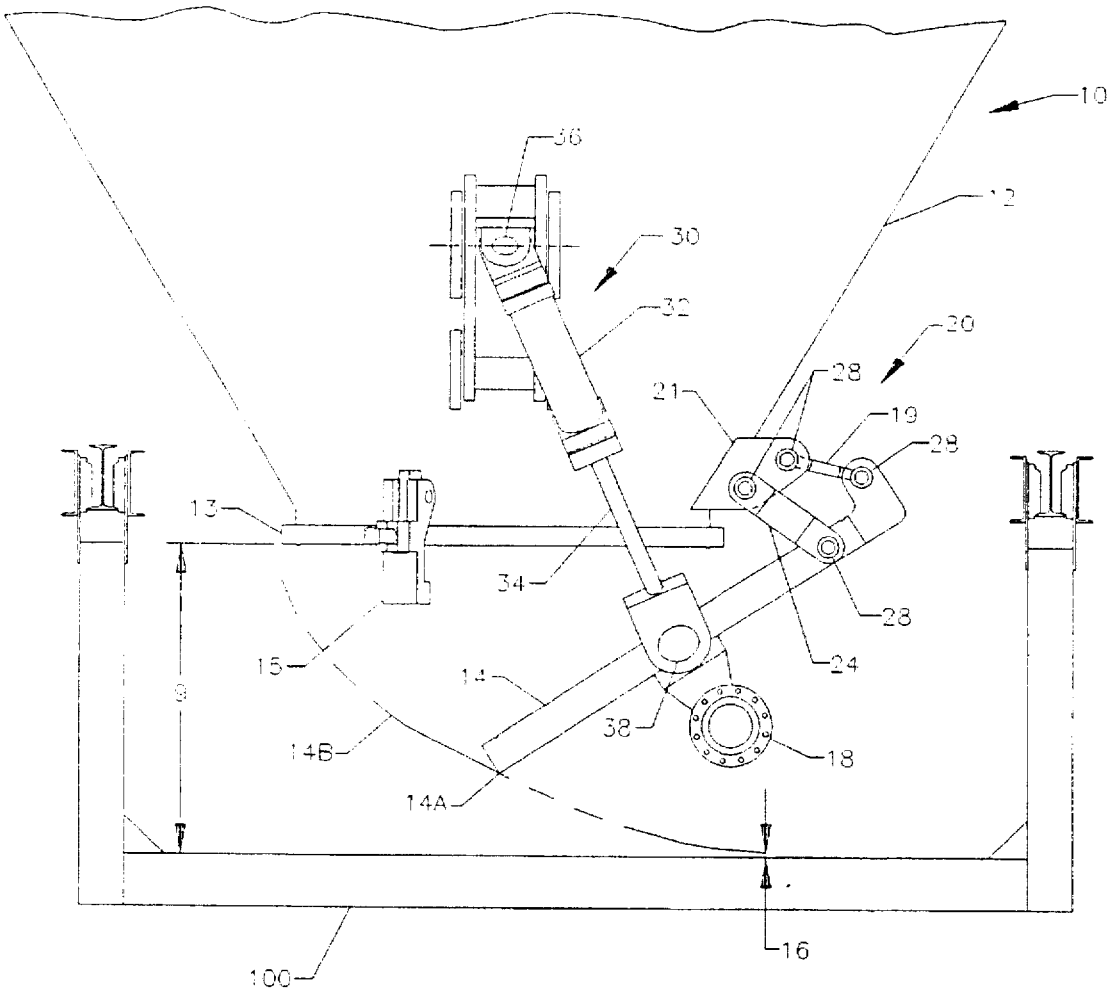
FIG. 1 is a schematic of a side view of the bottom portion of a delayed coker vessel in which the head is partly deheaded.

In FIG. 1 a delayed coker vessel 10 has a generally frusto-conical bottom portion 12 terminating in outlet flange 13. The upper portion of the vessel 10 is not shown, and in practice may extend 60–80 feet or more above the outlet portion. A bottom head 14 is hinged to bottom portion 12 using trammel pivot 20, and movement of head 14 is controlled by hydraulic cylinders 30 coupled to opposite sides of vessel 10. This arrangement causes point 14A on head 14 to trace out a fixed, non-circular path 14B during heading and unheading, which prevents the head 14 from striking floor or movable platform 100.

Figure 2:
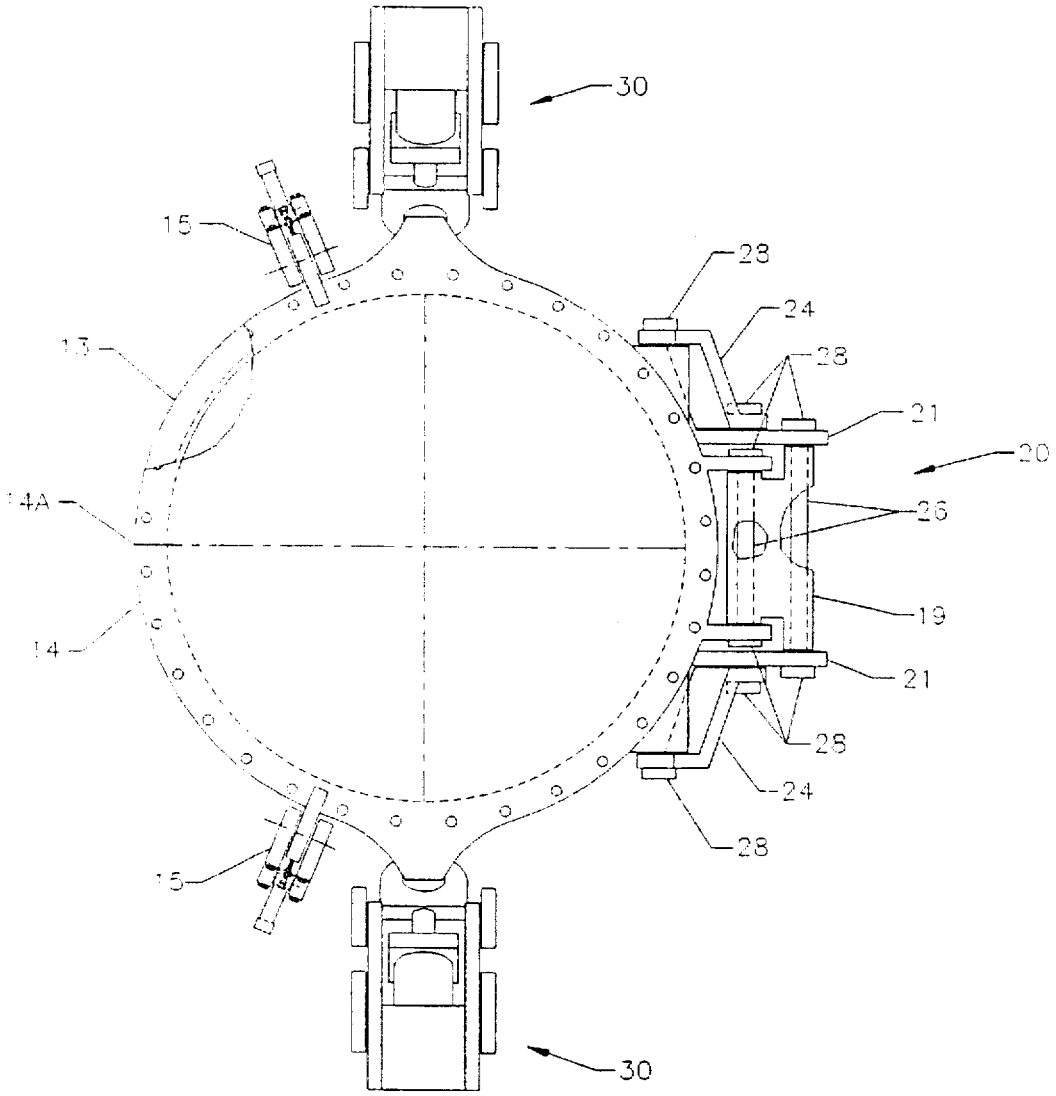
FIG. 2 is a schematic of a plan view of the bottom portion of a delayed coker vessel in which the head is locked in its closed position.
Figure 3:
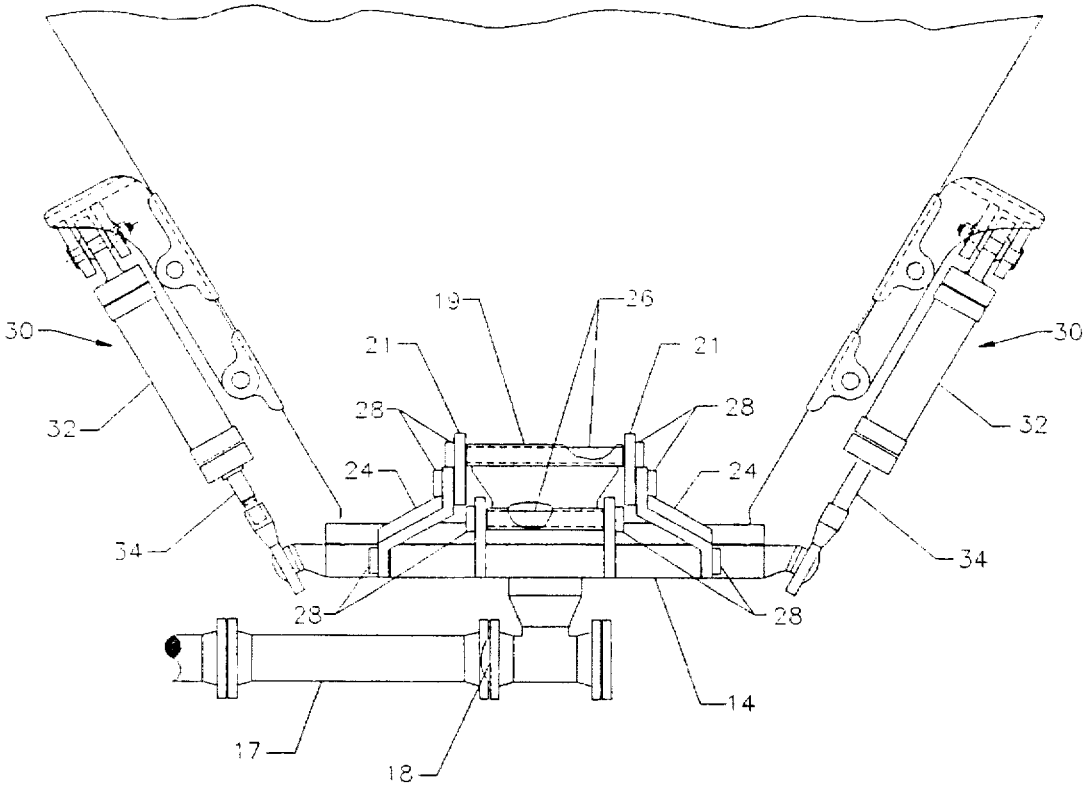
FIG. 3 is a schematic of a back view of the bottom portion of a delayed coker vessel.
Figure 4:
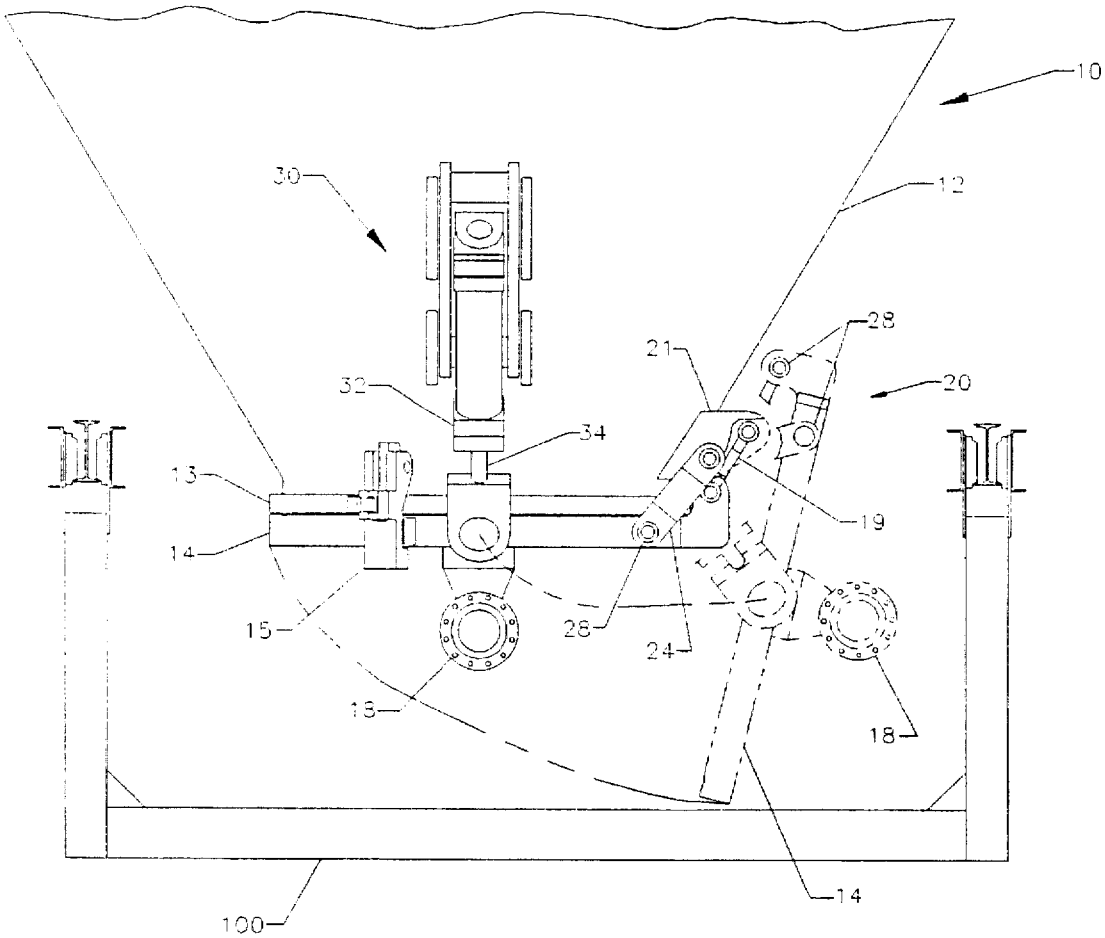
FIG. 4 is schematic of a side view of the bottom portion of a delayed coker vessel showing the head (a) locked in its closed position, and (b) in a fully opened position (in phantom).

As better visualized in FIGS. 2 and 3, trammel pivot 20 comprises a pair of connector plates 21, a forward pair of swing arms 24, a rear swing arm 19 having two axles 26, and four pairs of bearings 28, all of which cooperate in a well-known manner to determine the shape of path 14B. FIG. 3 additionally shows feed line 17 and feed input port 18. FIG. 4 depicts the same device of FIGS. 1 and 2, but with the head 14 locked in its closed position (solid lines) using locks 15, and the head 14 in its fully open position (phantom lines).

In the embodiment of FIGS. 1–4, the non-circular path 14B approximates an arc of an ellipse having an eccentricity of approximately 2:1. Since a path having an eccentricity of 1.0 is circular, the advantages described herein appear with paths having eccentricities other than 1.0. For example, paths having eccentricities greater than 1.5 (or less than 0.5 depending on how the path is viewed), accommodate cokers in which the available headroom is approximately one-half the diameter of the head. These numbers are only approximate because they depend in part on the tolerance 16 desired between the head and the floor at the head's lowest position (presently about 1" is deemed to be sufficient), and the low headroom clearance 9 relative to the outlet flange 13.

There are numerous alternative embodiments which fall within the spirit and scope of the claimed invention. For example, although vessel 10 is referred to as a drum, it need not be conically shaped, and the head need not be round. In alternative embodiments the body or head may have a rectangular, octagonal or some other regular or irregular cross-section, as long as the vessel can be sealed to contain the maximum pressure expected to be generated by the coking process.

Figure 5:
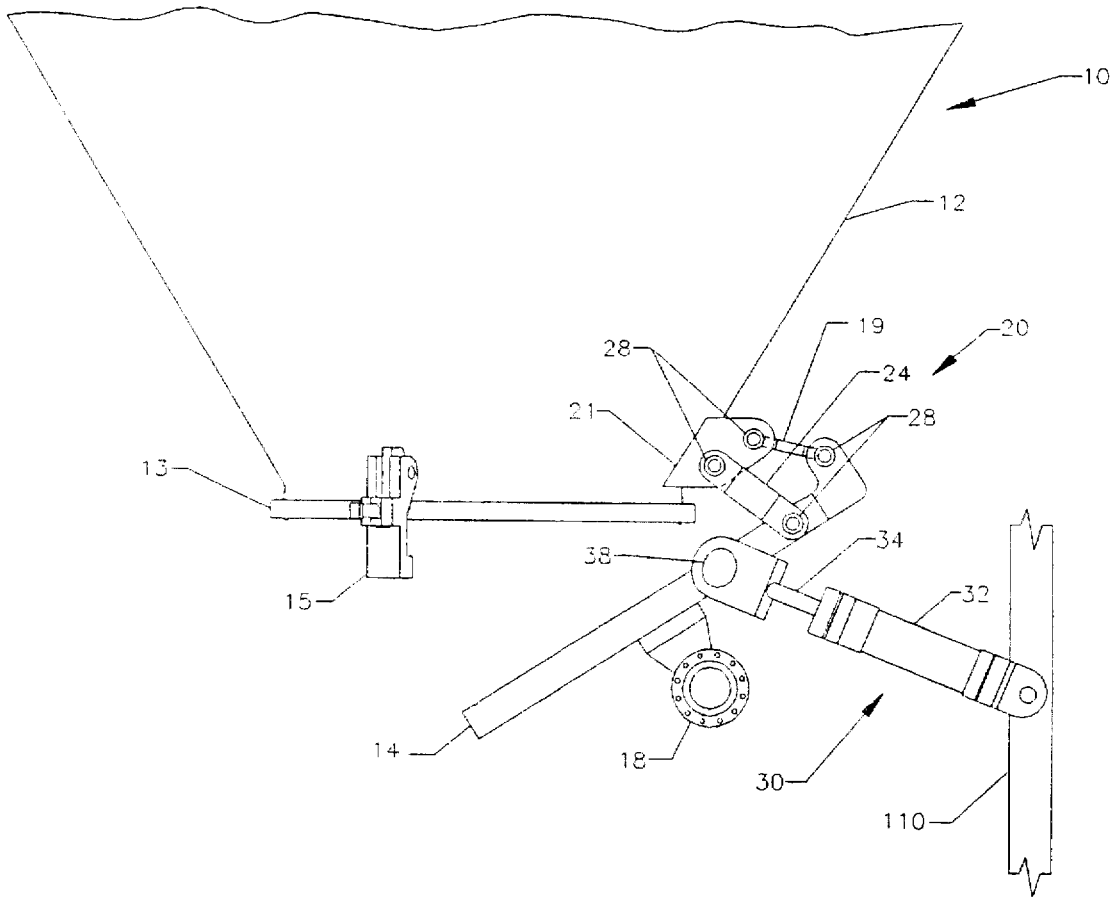
FIG. 5 is a schematic of a side view of the bottom portion of an alternative delayed coker vessel in which the hydraulic cylinder(s) are not attached to the coker body.

Cylinders 30, which comprise a cylinder portion 32 and a piston portion 34, need not be hydraulically actuated, but may incorporate any type of working piston or telescoping arm such as a pneumatic piston. Cylinders 30 may also have connection points other than the connection points 36, 38 shown in the drawings. For example, the connection point 38 of piston portion 34 to head 14, is shown approximately halfway along the cross-section of the head 14, but in alternative embodiments the connection point to the head may occur closer or farther away from the pivot 20. In many such embodiments, the head 14 will pivot during heading and unheading about a line drawn between the connection points 38 at the head. It should also be apparent that the connection point 36 of cylinder portion 32 to body 12 need not be horizontally centered on the body 12 as shown. As shown in FIG. 5, for example, cylinder portion 32 may be coupled to a wall 110 or other point not connected with the body 12.

Figure 6:
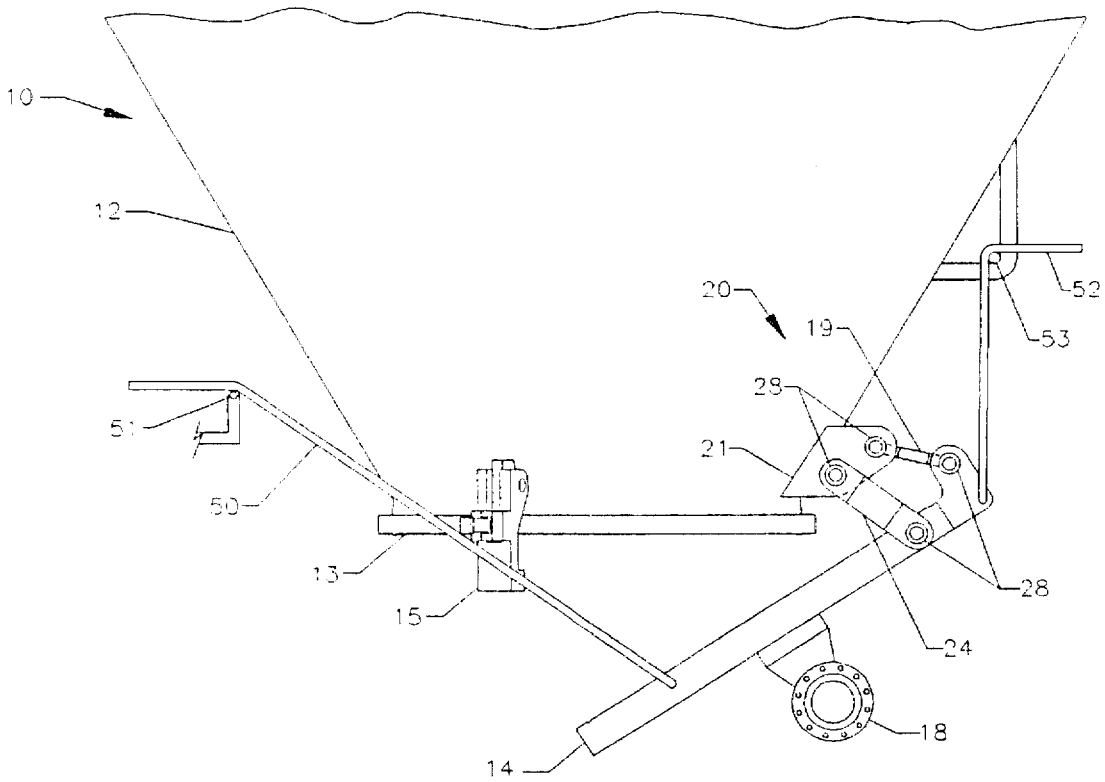
FIG. 6 is a schematic of a side view of the bottom portion in which the hydraulic cylinders are replaced by cables.
Figure 7:
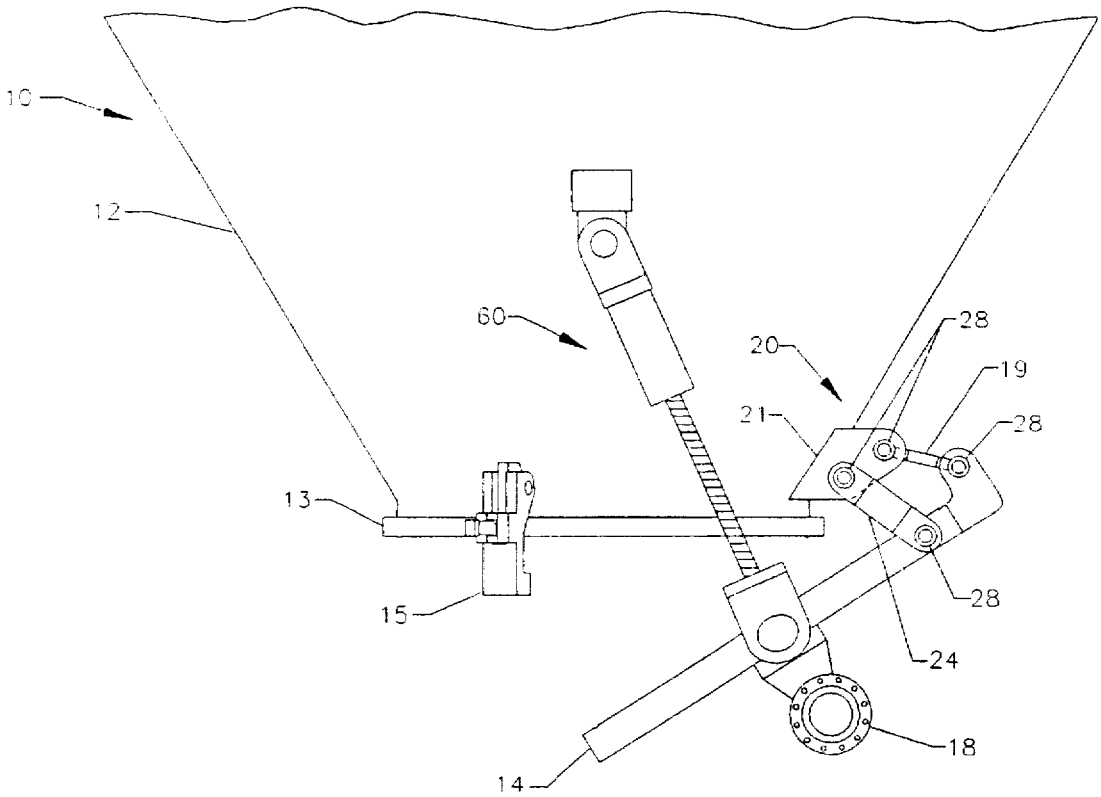
FIG. 7 is a schematic of a side view of the bottom portion in which the hydraulic cylinders are replaced by worm gear.

Cylinders 30 may also be replaced by some other actuating means, including the embodiment of FIG. 6 in which a pair of cables 50 is attached to opposite sides of head 14, and an additional cable 52 attached to the back of head 14. The cables are supported respectively by pulleys 51 and 53. In another embodiment cylinders 30 may be replaced by worm gears 60 as in FIG. 7.

The locking mechanism may be automated or manual, or some combination of the two. Numerous locking mechanisms are known in the art, and selection and employment of an appropriate mechanism is well within the ordinary skill of the art.

Figure 8:
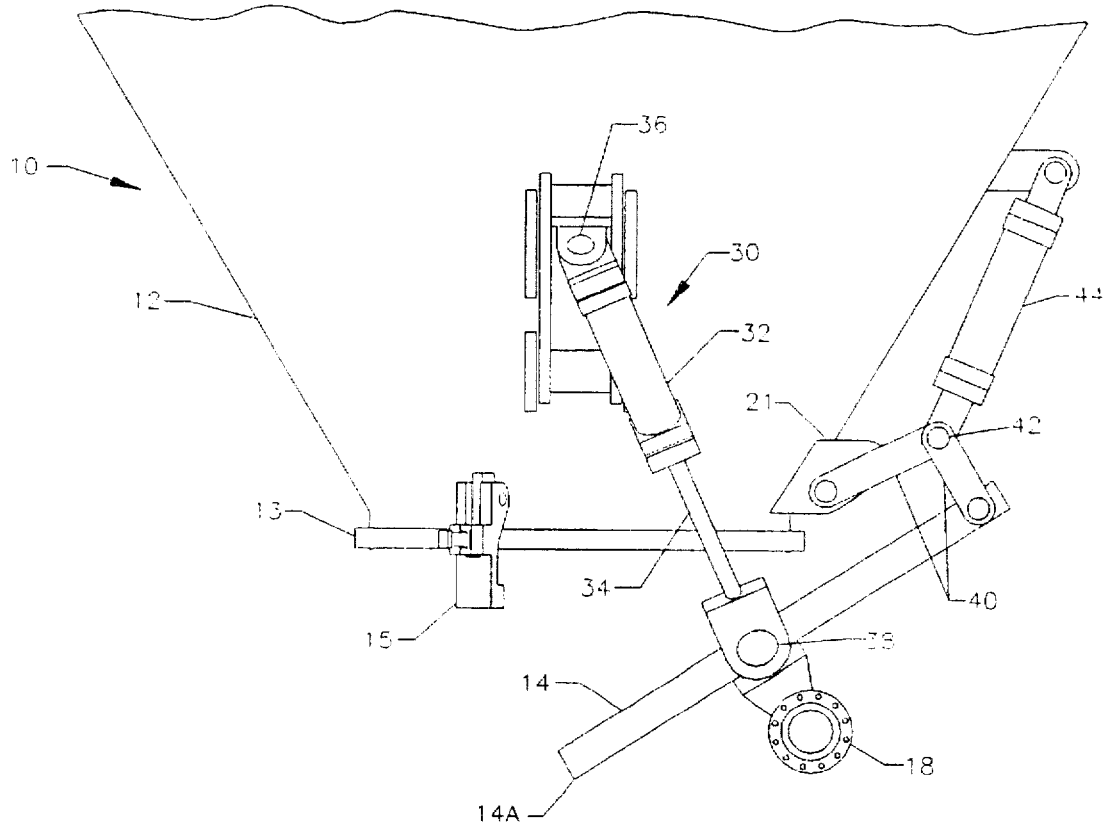
FIG. 8 is a schematic of a side view of the bottom portion in which the trammel joint is replaced by an alternative compound joint.

The trammel pivot 20 may be replaced by any number of compound joints which direct point 14A along a non-circular path. In one alternative depicted in FIG. 8, forward swing arms 24 and rear swing arm 19 of trammel pivot 20 are replaced by two arms 40 coupled to the body 12 and the head 14, and joined at elbow 42. The elbow 42 may be raised or lowered by one or more hydraulic cylinders 44, either directly as shown, or indirectly by attachment to one of the arms 40, to again produce a non-circular path of point 14A. In this embodiment the non-circular path is not fixed, but may be varied according to the relative operation of the various cylinders 30 and 44.

Thus, a method and device for reducing the headroom requirement in coker unheading operations has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A method of operating a coking vessel having a body and a removable head, the method comprising:

coupling the body to a first section of the head with a pivot;

opening the vessel by moving the head laterally while simultaneously raising the first section of the head and lowering an opposite section of the head; and closing the vessel by moving the head laterally while simultaneously lowering the first section of the head and rasing the opposite section of the head.

2. The method of claim 1 wherein the opening and closing of the vessel are facilitated by at least two working pistons coupled to juxtaposing sides of the body and head.

3. The method of claim 1 wherein the opening and closing of the vessel are facilitated by a working piston coupled to the head and to a fixture adjacent the vessel.

4. The method of claim 1 wherein the opening and closing of the vessel are facilitated by a first cable coupled to the first section of the head and a second cable coupled to the opposite section of the head.

5. The method of claim 1 wherein the opening and closing of the vessel are facilitated by a worm gear coupled to the head.

* * * * *